United States Patent [19]

Bergström et al.

[11] Patent Number: 4,505,145

[45] Date of Patent: Mar. 19, 1985

[54] EQUIPMENT FOR STRAIGHTENING DEFORMED VEHICLES OR VEHICLE PARTS

[75] Inventors: Hans R. Bergström, Kungsör; Uno Johansson, Linköping, both of Sweden

[73] Assignee: AB Samefa, Kungsör, Sweden

[21] Appl. No.: 381,637

[22] Filed: May 24, 1982

[30] Foreign Application Priority Data

May 26, 1981 [SE] Sweden ..... 8103295

[51] Int. Cl.[3] ..... B21D 1/14

[52] U.S. Cl. ..... 72/457; 72/705; 403/49; 403/323

[58] Field of Search ..... 72/705, 457; 403/49, 403/323, 324

[56] References Cited

U.S. PATENT DOCUMENTS 4,055,061 10/1977 Bayorgeon et al. ..... 72/705

FOREIGN PATENT DOCUMENTS 2145992 3/1973 Fed. Rep. of Germany ..... 72/705

2420248 11/1975 Fed. Rep. of Germany ..... 72/705

2027623 2/1980 United Kingdom ..... 72/705

OTHER PUBLICATIONS

Caroliner MK-II, by Samefa Manuf.

*Primary Examiner*—Lowell A. Larson

*Attorney, Agent, or Firm*—Fleit, Jacobson, Cohn & Price

[57] ABSTRACT

The present invention relates to equipment for straightening deformed vehicles or vehicle parts and includes a frame of beams on which the vehicle is fastened. One or more straightening devices can be fastened to the frame. The equipment has a U-shaped cross-section by being built-up from an upper and a lower plate and an intermediate plate, that joins them at some distance from their ends. This permits the fastening device to be brought into contact with the upper, lower and outer sides of a frame beam. Further the fastening device is provided with a blocking element which can be made to grip around the lower, inner corner of the beam and to be in contact with a lower part of the inner side of the beam and thereby lock the fastening device to the beam.

1 Claim, 2 Drawing Figures

EQUIPMENT FOR STRAIGHTENING DEFORMED VEHICLES OR VEHICLE PARTS

The present invention relates to equipment for straightening deformed vehicles or vehicle parts. When a vehicle is straightened it is first fixed to the floor or some type of bench, which supports the vehicle. With the help of different types of straightening devices tractive forces can then be applied to the vehicle. Between the tractions the distance between points on the vehicle with known positions is checked.

The present invention starts from a known straightening equipment comprising a frame of beams on which the vehicle is supported and fixed. One or more straightening devices can be fastened to the frame with the help of a fastening device on the straightening device. The fastening device is designed to be able to surround three sides of a frame beam with plates, the device being made with holes in the upper and lower plate for a locking pin which can be put through them and thereby extend along the fourth side of the beam. The middle part of the pin is eccentric in relation to the end parts of the pin. The fastener can thereby be locked to the beam by turning the pin.

This known solution shows however some troublesome disadvantages. It is among other things necessary to have free space around the entire beam along the entire bench as the fastening device grips around the entire beam. Further it is difficult to achieve a safe locking. By making the equipment for straightening vehicles with the characteristics that is evident from the following claim the disadvantages criticized are removed.

In the following the invention will be further described with reference to a preferred embodiment which is shown in the accompanying drawings in which.

Figure 1:
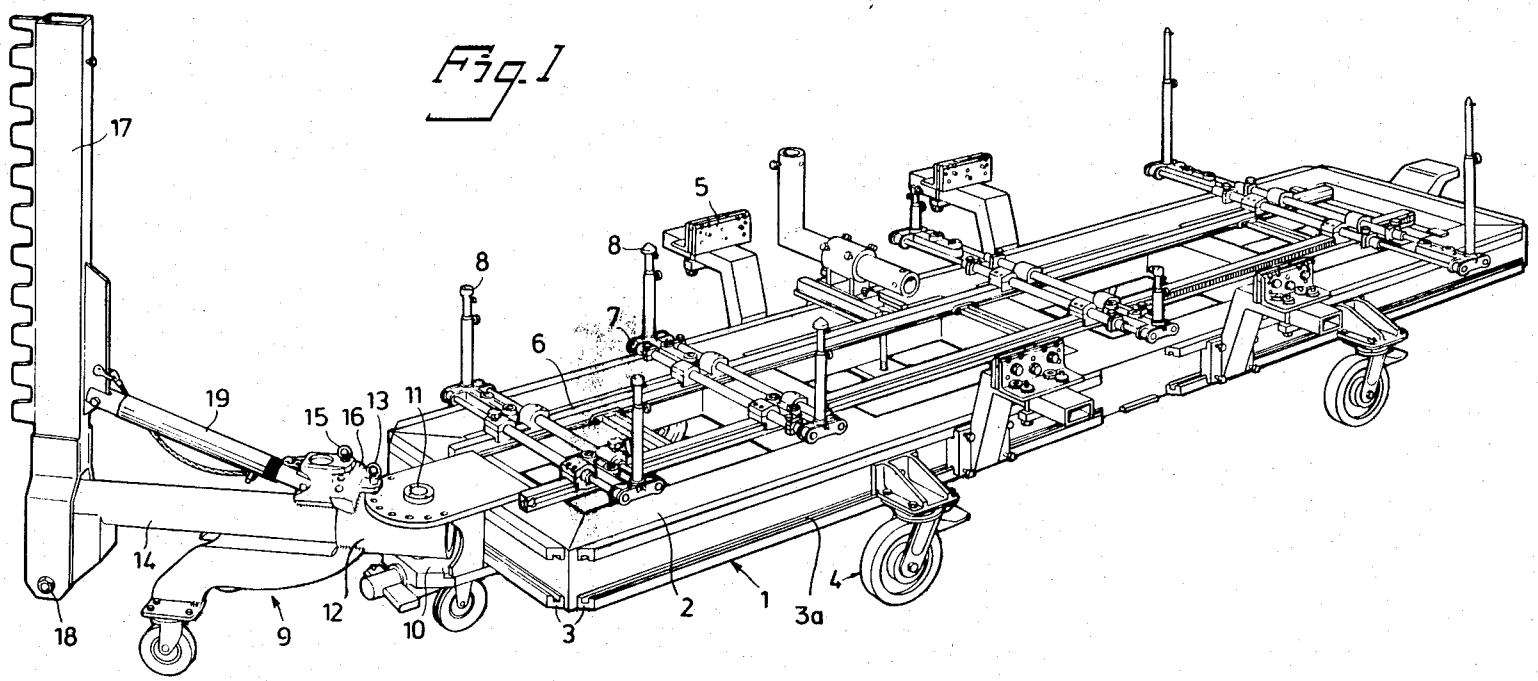
FIG. 1 shows a perspective view of the invention.

The straightening equipment comprises a frame 1 of beams 2. Along the outer sides of the frame it can suitably be provided with channels 3 having grooves 3*a*, which makes an easy fastening of different accessories possible, such as legs or, when the frame shall be moved, wheels 4 and clamps 5 for the supported vehicle. Thanks to the grooves the accessories can be mounted in any position and can easily be moved while the work is in progress.

Further, measuring equipment can be mounted on the frame 1, which equipment consists of a measuring bridge 6 with measuring slides 7, that are movable in a longitudinal direction. On the measuring slides measuring tools 8 are mounted, which can be moved in a lateral direction. By designing the measuring tools in different ways it is possible to measure between different types of measuring points, the correct position of which is accurately known from data sheets.

It is possible to fasten to the frame one or more straightening devices 9 as mentioned above. The straightening device comprises a fastening device 10 designed to be able to fasten the straightening device at any place to the frame 1. In the fastening device 10 a sleeve 12 is pivoted around a vertical shaft 11, which sleeve can be locked in the fastening device in determined angles with the help of a pin 13. An arm 14 is pivoted in the sleeve, so that it can turn around its longitudinal axis. The arm can be locked in certain positions by a pin 15 in a locking device 16.

Figure 2:
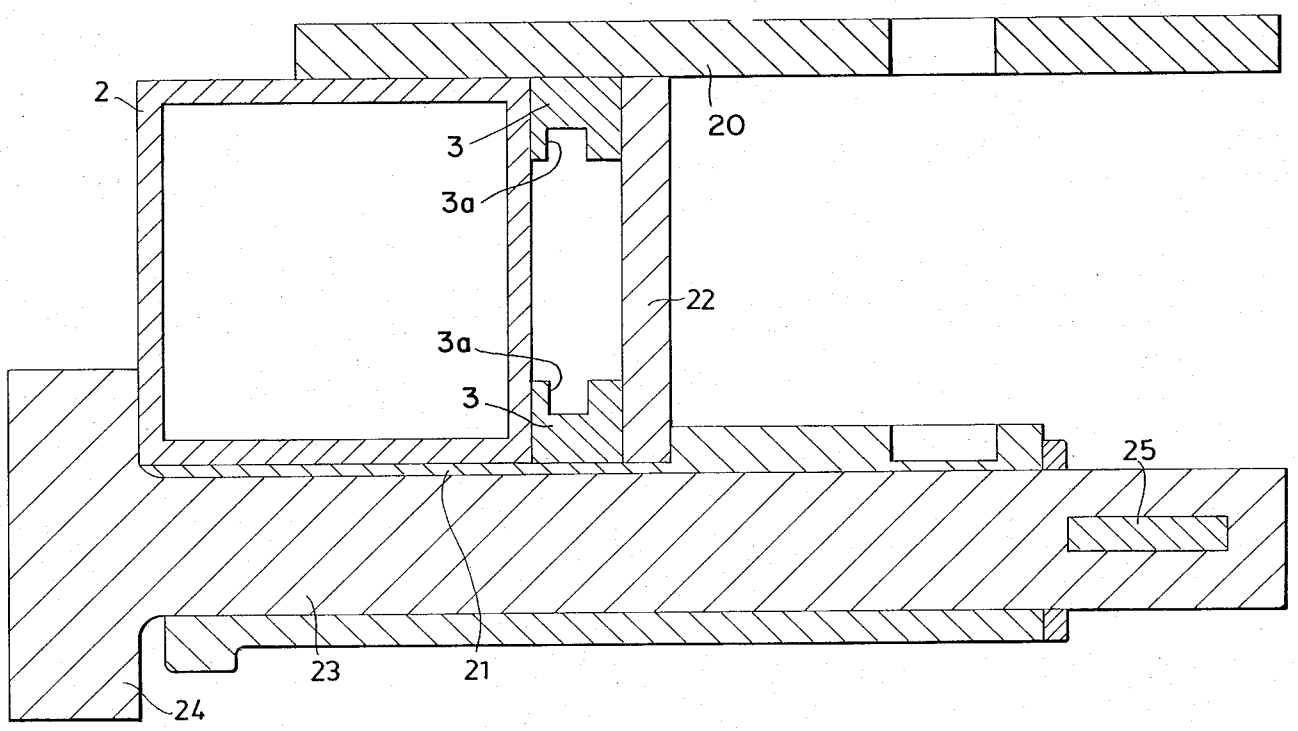
FIG. 2 shows a sectional view through the symmetry plane of the fastening device.

In the free end of the arm another arm 17 is mounted, pivoted around a shaft 18 which is perpendicular to the longitudinal axis of the first arm 14. A hydraulic cylinder 19 is mounted between the two arms 14 and 17 at some distance from their ends. With the help of the hydraulic cylinder 19 the angle between the arms can be changed, which movement via a chain or a similar element can be applied as tractive force on the vehicle. A preferred embodiment of the fastening device is shown in FIG. 2 from which it is evident that one of its ends has a U-shaped cross-section by being built up from an upper 20 and a lower 21 plate and an intermediate plate 22, that joins them at some distance from their ends. These plates can be brought into contact with the upper, lower and outer side of a frame beam 2.

The fastening device is further provided with a blocking means 23, which can be made to grip around the lower, inner corner of the beam and to be in contact with a lower part of the inner side of the beam and thereby lock the fastening device 10 to the beam 2. It is extremely important that the blocking means is designed in this way. In order to make the fastening device function well it is absolutely crucial that the blocking means grips around the lower, inner corner. During all normal straightening operations the tractive force attacks the vehicle in such a way that a torsional moment arises around the frame beam 2, which tends to lift the straightening device 9. This movement is very effectively stopped by the mentioned design of the fastening device and the blocking means. According to a preferred embodiment, the blocking means 23 itself can be T-shaped, which permits easy use both from the left and the right side. When its head 24 is horizontally directed the fastening device 10 can be moved across the frame beam 2. The head 24 can then be brought into contact with the lower part of the inner side of the beam 2 by simply turning the blocking means 23 through 90° so that the head is vertical.

The blocking means 23 can then be locked in this position with the help of a wedge 25 which is beaten through a hole in the end of the blocking means. If the wedge is designed so that it does not drop off when it is beaten loose by being fitted with a transverse pin or the like in its narrow end, it is possible moreover to obtain the advantages that the wedge, after it has been loosened, turns the blocking means to the free position owing to its weight. This is a convenient design of the blocking means.

Although described in connection with a preferred embodiment of the invention it is obvious that the invention can be designed in several different ways within the scope of the following claim.

We claim:

1. Apparatus for straightening deformed vehicles or vehicle parts comprising: a frame of beams on which the vehicle is fastened; a straightening device for applying tractive forces to the vehicle; and a fastening device fastening the straightening device to the frame, said fastening device being in abutting engagement with the upper, lower and outer sides of a frame beam and having a U-shaped cross-section including an upper and a lower plate and an intermediate plate that joins the upper and lower plates at some distance from their ends, said fastening device adapted to be brought into contact with the upper, lower and outer sides of a frame beam and including an arm device and a vertical shaft extending between said upper and lower plate to pivotally receive said arm device, said arm device being lockable in predetermined angles with respect to the frame so that tractive force can be applied to the vehicle, said lower plate of the fastening device carrying a blocking means adapted to grip around the lower, inner corner of the beam and to contact a lower part of the inner side of the beam and thereby lock the fastening device to the beam, said blocking means including a head to engage the lower, inner corner of the beam and being movable relative to said lower plate to permit close contact with the beam, and means on said blocking means to lock said blocking means in position.

* * * * *